US011291310B2

(12) United States Patent
Plant et al.

(10) Patent No.: US 11,291,310 B2
(45) Date of Patent: Apr. 5, 2022

(54) CHAIR

(71) Applicant: Blue Cube (GB) Ltd., London (GB)

(72) Inventors: Russell Plant, London (GB); Daniel Chi Man Ho, London (GB)

(73) Assignee: BLUE CUBE LTD., London (GB)

( * ) Notice: Subject to any disclaimer, the term of this patent is extended or adjusted under 35 U.S.C. 154(b) by 0 days.

(21) Appl. No.: 17/085,238

(22) Filed: Oct. 30, 2020

(65) Prior Publication Data

US 2021/0127850 A1 May 6, 2021

(30) Foreign Application Priority Data

Oct. 30, 2019 (GB) ..... 1915785

(51) Int. Cl.

| | |
|---|---|
| ***A47C 7/24*** | (2006.01) |
| ***A47C 31/02*** | (2006.01) |
| ***A47C 7/40*** | (2006.01) |
| ***A47C 7/28*** | (2006.01) |
| *A47C 7/58* | (2006.01) |

(52) U.S. Cl.

CPC ..... *A47C 31/023* (2013.01); *A47C 7/282* (2013.01); *A47C 7/40* (2013.01); *A47C 7/58* (2013.01)

(58) Field of Classification Search

CPC ..... A47C 31/023; A47C 7/282; A47C 7/40; A47C 7/58

USPC ..... 297/218.1, 218.3, 218.5, 452.56

See application file for complete search history.

(56) References Cited

U.S. PATENT DOCUMENTS

| | | | | |
|---|---|---|---|---|
| 5,601,333 | A * | 2/1997 | Bostrom | A47C 31/06 297/218.1 |
| 6,378,944 | B1 * | 4/2002 | Weisser | A47C 7/282 297/218.5 X |
| 6,899,398 | B2 * | 5/2005 | Coffield | A47C 7/282 297/452.56 |
| 7,425,039 | B2 * | 9/2008 | Lin | A47C 31/023 297/452.56 |
| 8,029,066 | B2 * | 10/2011 | Su | A47C 7/40 297/452.56 X |
| 8,109,576 | B2 * | 2/2012 | Lin | A47C 7/40 297/452.56 |
| 8,616,655 | B2 * | 12/2013 | Jung | A47C 7/282 297/452.56 |

(Continued)

FOREIGN PATENT DOCUMENTS

| | | | |
|---|---|---|---|
| CA | 2359154 A1 * | 4/2003 | A47C 31/02 |
| EP | 1380232 A1 | 1/2004 | |

OTHER PUBLICATIONS

Great Britain Search Report dated Feb. 28, 2020 of corresponding Great Britain Patent Application No. GB1915785.8.

(Continued)

*Primary Examiner* — Rodney B White

(74) *Attorney, Agent, or Firm* — Fay Sharpe LLP

(57) ABSTRACT

A seat or back for a chair comprises a frame having a first edge strut and a second edge strut, the first and second edge struts being on opposite edges of the seat or back. The first edge strut has a groove along all or most of its length, an elongate insert, and a mesh, the mesh being attached to the insert along an edge of the mesh. The insert has a section shaped to correspond to the section of the groove, such that the insert can be urged into the groove, the compression of the groove holding the insert in place.

4 Claims, 12 Drawing Sheets

(56) References Cited

U.S. PATENT DOCUMENTS

| | | | | |
|---|---|---|---|---|
| 2004/0124689 | A1* | 7/2004 | Numa | A47C 31/023 297/452.56 |
| 2007/0102987 | A1* | 5/2007 | Chen | A47C 31/02 297/452.56 |
| 2010/0237679 | A1* | 9/2010 | Tsukiji | A47C 31/023 297/452.56 X |
| 2011/0057497 | A1* | 3/2011 | Wang | B60N 2/7011 297/452.1 |
| 2020/0163465 | A1* | 5/2020 | Su | A47C 31/023 |

OTHER PUBLICATIONS

Wayback Machine, May 2016, The Box Seat [online], available from: https://web.archive.org/web/20160529131954/https:/www.theboxseat.co/innovations/ [accessed Feb. 2020], 1 page.

* cited by examiner

CHAIR

REFERENCE TO RELATED APPLICATION

This Application claims priority to, and the benefit of, GB application no. 1915785.8, entitled "Chair", filed Oct. 30, 2019, the entirety of which is hereby incorporated herein by reference, The present invention relates to chair, in particular to a chair to be mounted to a support in stadia, sports arenas.

Chairs for stadia and sports arenas are typically made and installed in large numbers. They are often assembled from parts on site, with a mounting means being attached to a horizontal beam with supports a line of chairs, and the seat and the back being attached to the mounting means. It is important that they can be assembled quickly and efficiently.

Some components, such as the seat and back of the chair, may be covered in a mesh or fabric, which makes them more comfortable. It is desirable when fabricating the seat and back that this mesh can be fitted easily. The mesh is vulnerable to vandalism, so it is also desirable that the mesh, as well as being fitted easily and securely, can b replaced easily if required.

The object of the present invention is to provide a chair that can be assembled efficiently and conveniently. Another object of the invention is to provide a chair whose covering material can be fitted and/or replaced efficiently and conveniently.

According to the present invention, there is provided a chair as defined by the independent claims.

In order that the present invention may be more fully understood a specific embodiment will now be described by way of example with reference to the accompanying drawings, of which:

In this specification the term "comprising" in relation to an apparatus/method/product is intended to be interpreted as meaning that it includes those features, but that it does not exclude the presence of other features.

Terms such as "top", "bottom" "front" and "rear" and their cognates are intended to be interpreted in relation to a user sitting in the chair looking ahead as seated normally. Terms such as "inner" and "outer" and their cognates are intended to be interpreted in relation to a facing or pointing inwards or outwards to a centre point or line of the part.

Figure 1:
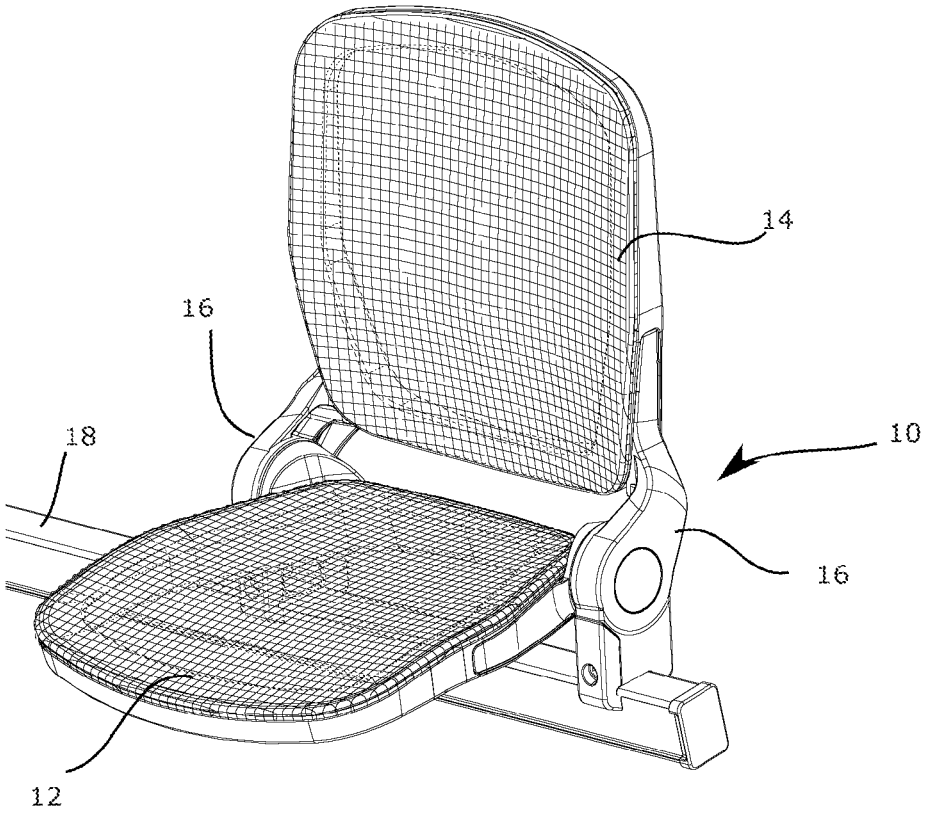
FIG. 1 shows a perspective view of an embodiment of the chair.

Referring to FIG. 1, a chair 10 comprises a seat 12 and a back 14, both secured to a support arm members 16, which are themselves mounted on a support beam 18.

Figure 2:
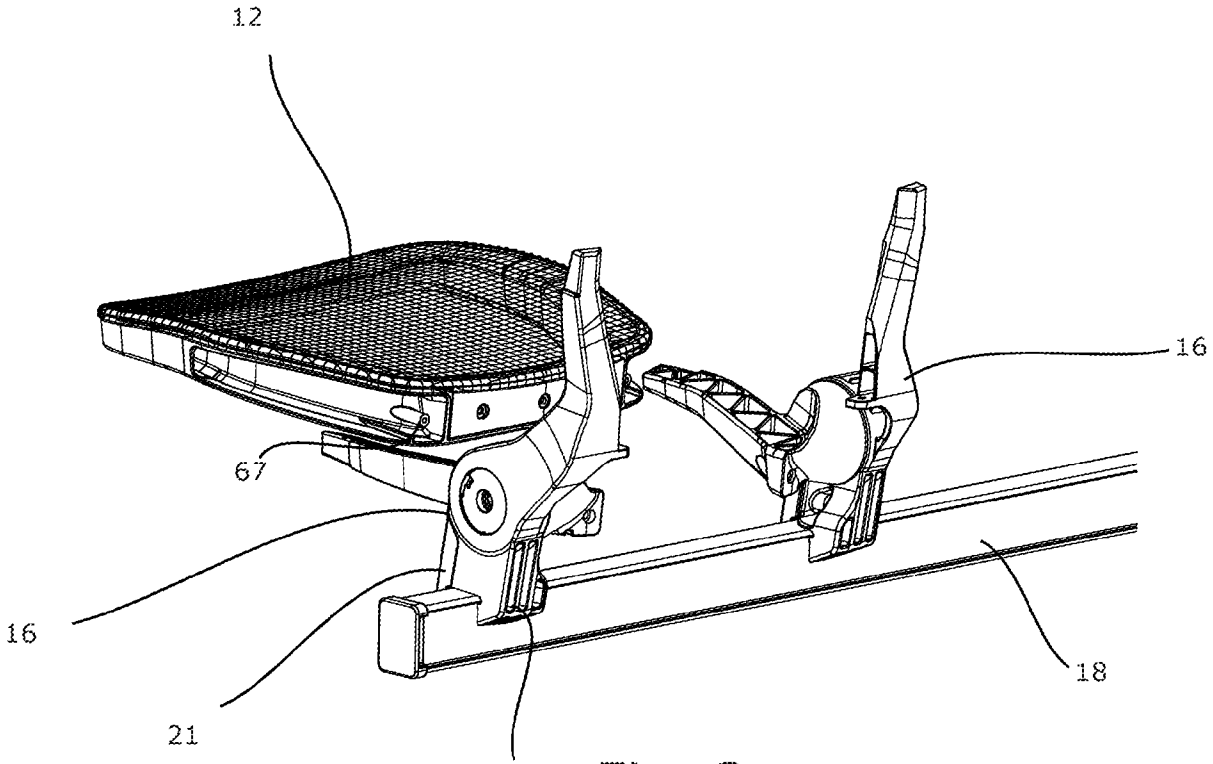
FIG. 2 shows a perspective view of the support arm members and seat of the chair.
Figure 3:
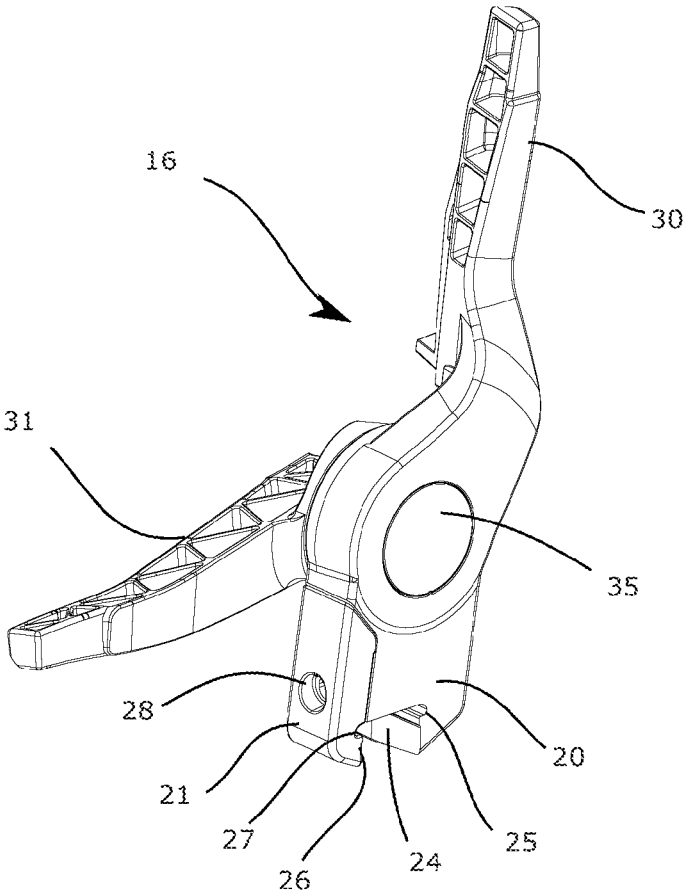
FIGS. 3 and 4 show perspective views of a support arm member of the chair.
Figure 4:
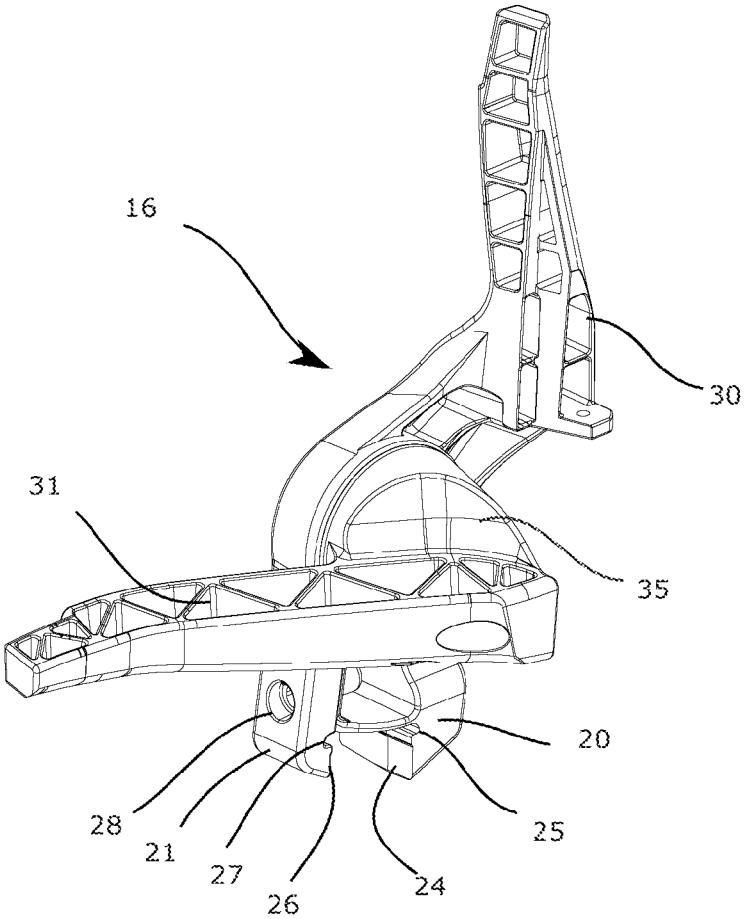
Figure 5:
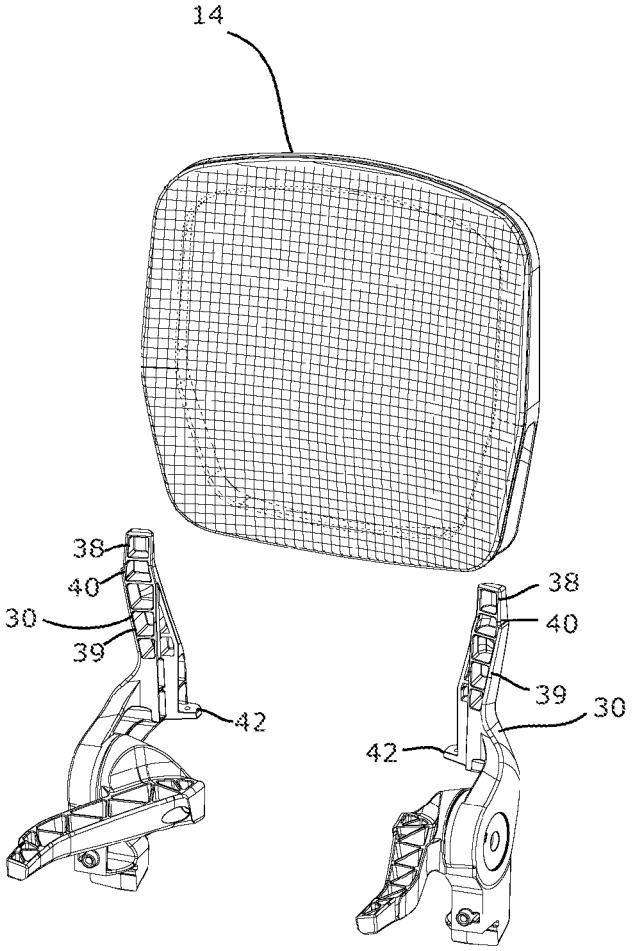
FIGS. 5 and 6 shows perspective views of the support arm members and back of the chair.

Referring to FIG. 2, the support arm members 16 each have a foot 20 and clamp part 21 are shaped to engage with the support beam 18. The support beam 18 is preferably I-shaped, though the flanges so not need to be prominent, and other shapes may be used. Referring to FIGS. 3 and 4, the foot 20 has a shaped clamping surface 24 that includes a notch 25, and the clamp part 21 has a similar clamping surface 26 and notch 27. The foot 20 can be positioned against the support beam 18 so that an upper flange of the support beam 18 locates in the notch 25, and the clamp part 21 positioned on the other side of the support beam 18 so that the remaining upper flange engages the notch 27 of the clamping surface 26 of foot 20. The clamp part 21 includes a fixing element such as a bolt 28 that can then be advanced through aligned threaded apertures that extend through the clamp part 21 and the foot 20 to fasten the clamp part 21 to the foot 20, and thus secure the support arm member 16 to the support beam 18. It will be appreciated that other fixing designs can be used to secure a support arm member 16 to a support beam 18 or other support structure.

The support arm member 16 includes a back horn 30 and a seat horn 31. The back horn 30 extends generally upwardly from a pivot 35 above the foot 20, and the seat horn 31 is secured to a pivot 35; the back horn 30 is ideally integral with the foot and the housing of the pivot, while the seat horn 31 is pivotally attached to the pivot, and can rotate about the pivot 35 with respect to the other parts of the support arm member 16.

Figure 7:
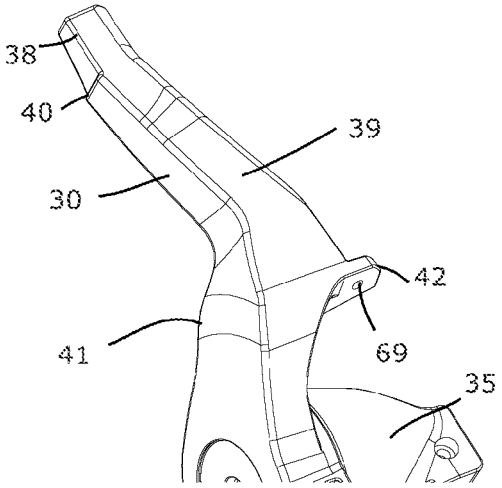
FIG. 7 shows a perspective view of part of the support arm member.

Two support arm members are mounted at a spaced interval on the support beam 18, and the seat 12 and back 14 are mounted on the back horns 30 and seat horns 31. The two support arm members 16 are oppositely configured and arranged as mirror images, and the back horns 30 of the two support arm member 16 diverge somewhat. Referring to FIG. 7, each back horn 30 is set on a shoulder portion 41 which brings the back horn 30 inwardly towards the other back horn 30 of the support arm member 16. As the back horn 30 extends away from the pivot, the back horn 30 tapers or narrows in width. More specifically, the back horn 30 has a first portion 38 that extends from the shoulder portion 41 and extends to a second portion 39, which extends further and terminates in a free end. The first portion 38 may conveniently have a square section, and the width between opposite sides of the square of the section reducing as the first portion 38 extends distally from the shoulder portion 41. The distance from one first portion 38 to the other first portion 38 also increases as the first portion 38 extends distally, so the two first portions diverge.

The second portion 39 also conveniently has a square section, with smaller dimensions than the first portion 38 where the first portion 38 and second portion 39 meet, so that there is a step 40 where the first portion 38 and second portion 39 meet. The second portion 39 also may conveniently have a square section, however the width between opposite sides of the square of the section does not reduce or reduces less than that of the first portion 38 as the second portion 39 extends distally from to its free end. The distance from one second portion 39 to the other second portion 39 does not increase, or does not increase at the same rate, as the second portion 39 extends distally. That is, the second portion 39 need not taper, or tapers less than the first portion, and the two second portions do not diverge or diverge less than the two first portions.

Each back horn 30 has a stop 42 that faces inwardly towards the adjacent back horn 30 of the chair 10.

Figure 8:
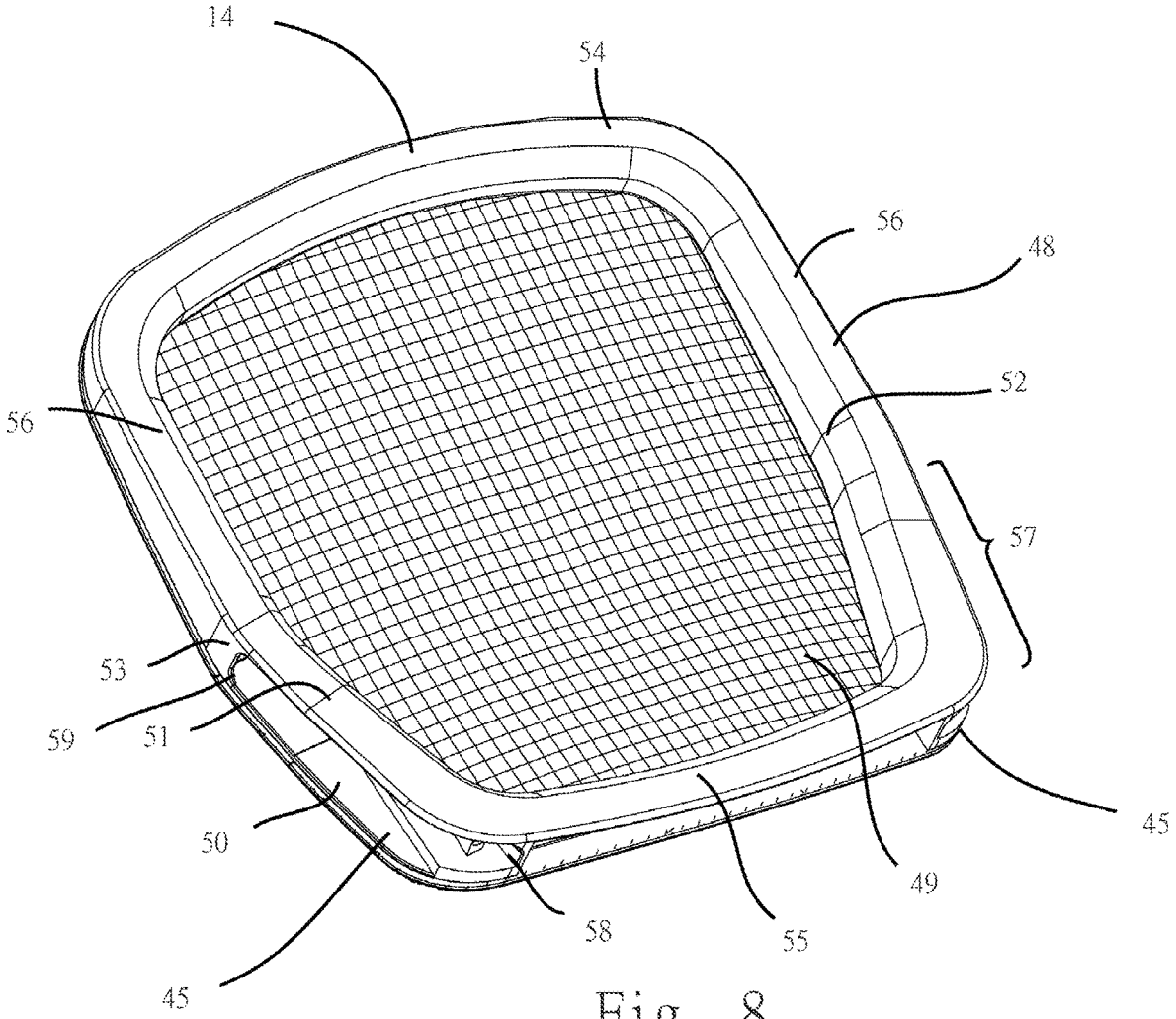
FIG. 8 shows a perspective view of the rear of the back of the chair.
Figure 9:
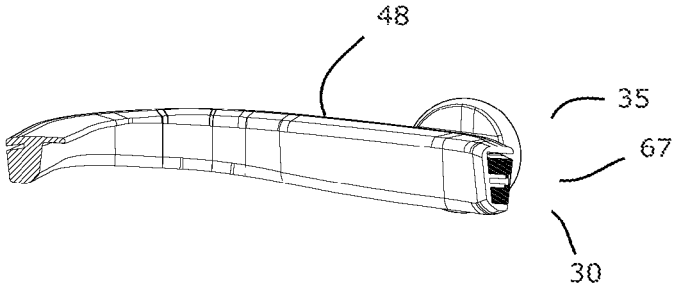
FIG. 9 shows a perspective sectional view of the front strut of the back of the chair.

Referring to FIG. 8, the back 14 comprises a frame 48 which supports a mesh 49. The frame is generally square defined by a top strut 54, bottom strut 55 and two side struts 56. The top strut 54 may be bowed as is conventional with a chair back. The side struts 56 are not straight, but each have a lower portion 57 which is angled from the rectilinear, so that the two side struts 56 diverge from each other in the direction from the bottom strut 55 to the top strut 54.

The top strut 54 and side struts 56 have an inner wall 52, front wall 50, rear wall 51, and outer wall 53, defining a square tubular section, however the lower portion 57 of the side struts 56 lack the outer wall 53, so as to define open channels, while the lower edge 59 of the outer wall 53 of the side struts 56 forms the entrance of a cavity that extends into the side struts 56.

Figure 6:
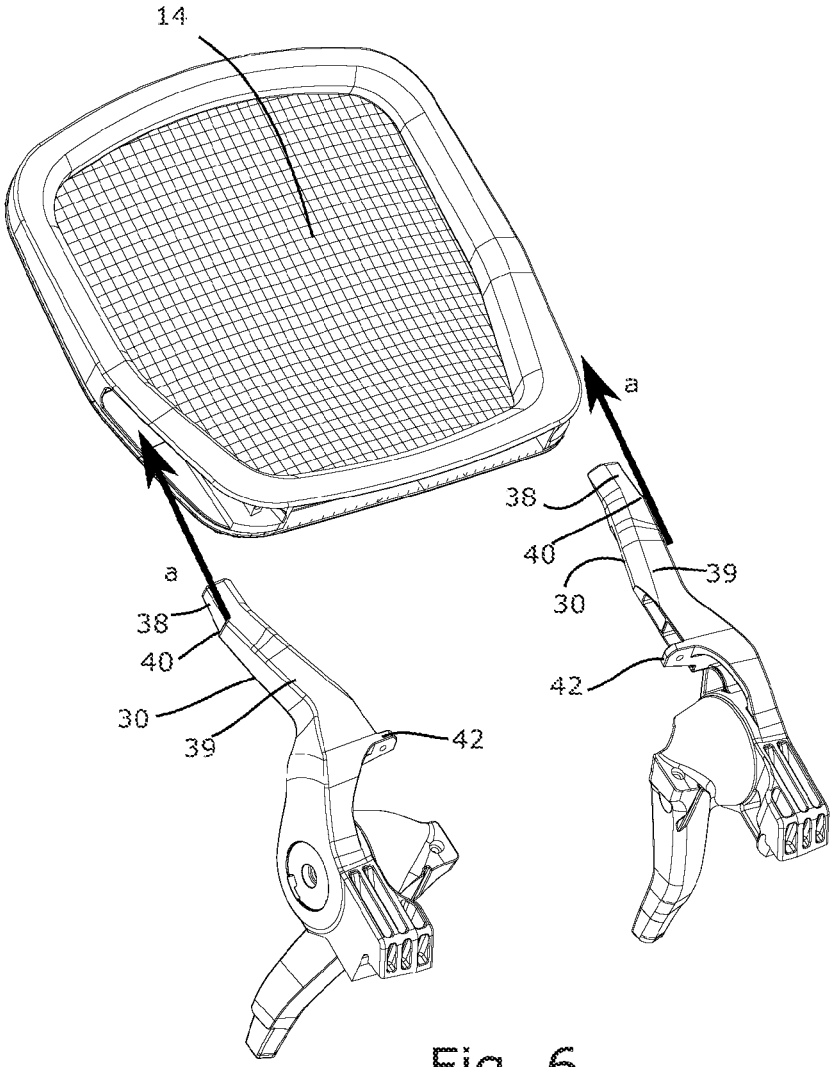

Referring to back to FIG. 6, in order to mount the back 14 on the support arm members 16, the back horns 30 are moved in the direction shown by arrows a (in practice, this is achieved by lower the back 14 onto the support arm members 16) so that the back horns 30 engage with the back 14. As the back horns 30 move in relation to the back 14, the second portion 39 of each back horn 30 enters channels 45 of the side struts 56, and continues to advance until the second portion 39 of each back horn 30 enters the cavity 46 (which may have an internal taper corresponding to that of the back horn 30) of each side strut 56. A this point, the step 40 of each back horn 30 abuts the edge 59 of the outer wall 53 of each side strut 56, and the stop 42 abuts the lower edge of inner wall 52. The front wall 50 and rear wall 51 constrain and guide the relative movement of the back horns 30 into the channel 45 and cavity 46 of the back 14.

Figure 12:
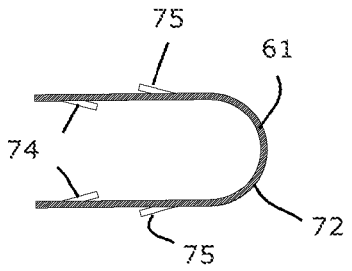
FIG. 12 shows cross section of a clip.

Once the step 40 of each back horn 30 abuts the edge 59 of the outer wall 53 and the stop 42 abuts the lower edge of inner wall 52, the back 14 is correctly positioned on the bottom support arm members 16, and the back 14 and support arm member 16 can be secured together to prevent further movement. Referring to FIG. 12, a threaded post 67 extends downwards at each corner of the side struts 56 and bottom strut 55, so that a screw may be passed through an aperture 69 on the stop 42 to secure the back horns 30 to the back 14.

Referring back to FIGS. 3 and 4, the seat horn 31 extends from the pivot 35 of the support arm member 16 in a similar manner to the back horn 30; the seat horn 31 can though rotate from the pivot 35 in vertical plane. The seat 12 is configured in the same way as the back 14. The seat horns 31 are also shaped in the same manner as the back horns 30 Thus, the seat 12 when mounted on the seat horns 31 can fold from a generally horizontal orientation to a generally vertical position where it is brought up against the back 14.

Figure 10:
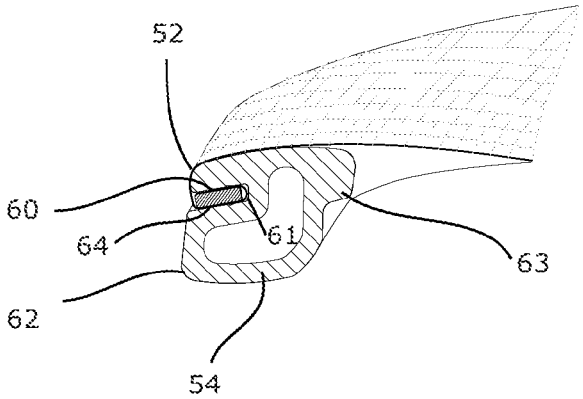
FIG. 10 shows a sectional view of part of the covering the mesh and insert for the back of the chair.
Figure 11:
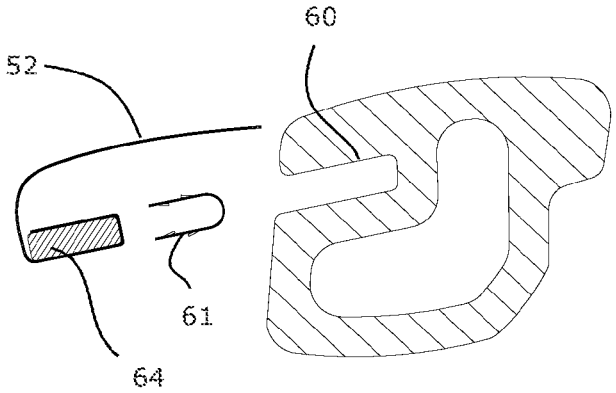
FIG. 11 shows a perspective sectional view of the front strut of the back of the chair and part of the covering the mesh and insert for the back of the chair.

The mode of affixing the mesh to the back 14 is shown in FIGS. 10 to 12, which is the same in material particulars to the mode by which the mesh is affixed to the seat 12. The frame 48 of the back 14 is conveniently formed of moulded material, of which the top strut 54 is shown in FIG. 10, the other struts being similarly formed, and may conveniently be formed by gas injection moulding to produce a hollow structure. The top strut of the back 14 includes a groove 60 formed in the upper surface 62 of the top strut 54, this groove 60 extending along most or all of the length of the top strut 54. The mesh 49 of the seat is shaped and dimensioned to cover one side of the back 14 (the forward-facing side of the back 14), and a border region along one edge (or along a substantially part of one edge) of the mesh 49 is attached to an insert 64, the insert ideally is made from extruded PVC. Referring to FIG. 11, the insert 64 has a substantially rectangular cross-section, and is dimensioned to form an interference fit with the groove 60. It may conveniently be formed from PVC. The portion of the mesh 49 to be secured to the top strut 54 is attached to the insert 64 in a partially wrapped manner, so that the edge of the mesh is secured to the upper long side of the cross section of the insert 64, and contacts the insert on one short side of the insert, before doubling-back on the lower long side of the insert. When the insert is inserted into the groove 60, the mesh 49 is gripped between three sides of the outer surface of the insert 64, and the three faces of the inner surface of the groove 60. To further secure the mesh 49, a number of clips 61 are included, which fit between the fabric and the inner faces of the groove 60.

Figure 13:
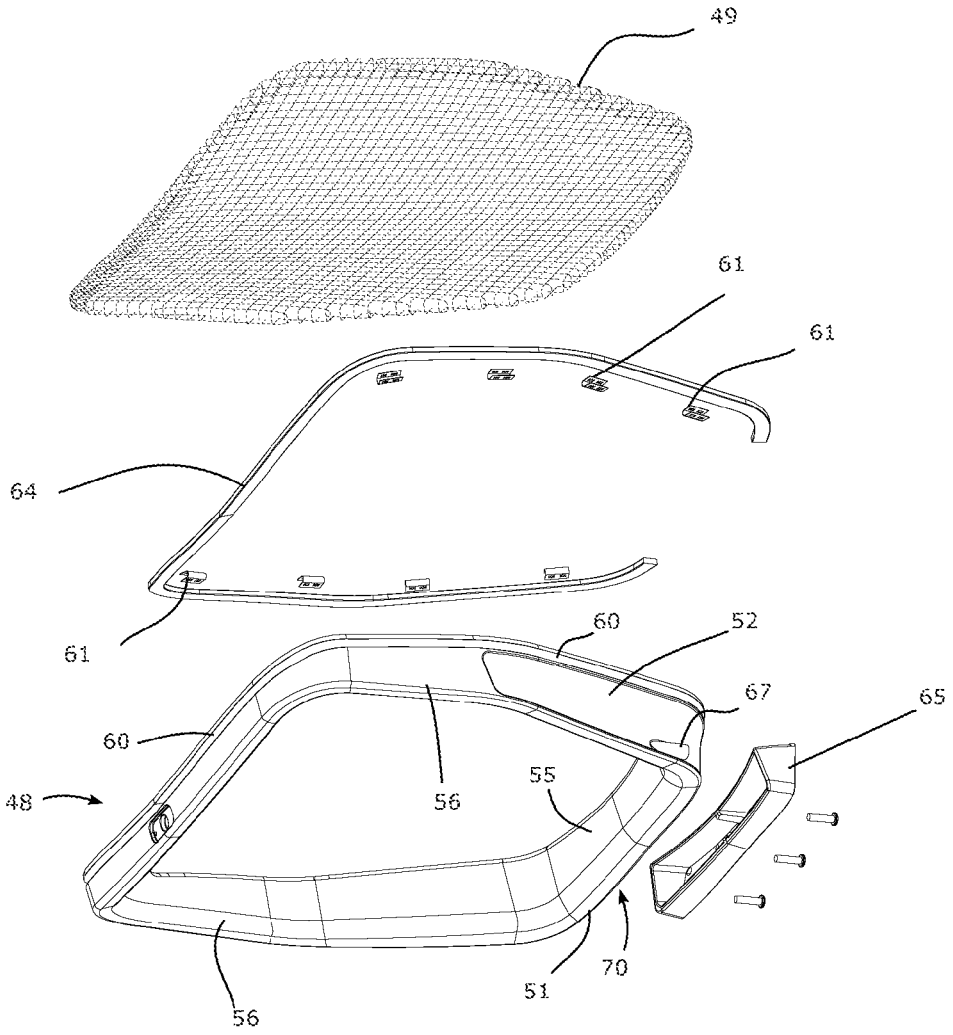
FIG. 13 shows a perspective view of the front of the back of the chair in a partially disassembled state.

Referring to FIG. 12, the cross section of the clip 61 comprises a C-shaped web 72 having two substantially flat parallel portions joined by an arcuate portion. The clip 61 features forward pointing barbs 74 on the inner surface of the clip, and backward pointing barbs 75 on the outer surface of the clip 61. These barbs are slightly inclined to the surface of the clip where they protrude, and may end in a sharp tip. The barbs may be formed by cutting and deforming the material of the web. Referring also to FIG. 13, to fit the mesh 49 to the back 14, when attaching the insert and mesh to the seat, after the mesh 49 has been secured to the insert 64, for example by adhesive or by plastic welding, the clip 61 is pushed over the mesh and fabric, the forward pointing barbs 74 allowing this movement, but if a force is applied to separate the insert and the clip, the tips of the forward pointing barbs 74 catch with the mesh 49 and the insert 64, resisting the movement of the insert relative to the clip in this direction.

The insert 64, mesh 49 and clip 61 are then forced into the groove 60 of the top strut, for example by hammering the insert 64 with a plastic mallet in the region and direction indicated by arrow 1, and then at the top corners of the back in the regions and direction indicated by arrows 2, so that the insert 64 and groove 60 distort to allow the insert 64 to be forced into the groove 60. The backward pointing barbs 75 of the clip 61 permit this insertion, however any force tending to extract the insert 64, mesh 49 and clip 61 causes the tips of the backward pointing barbs 75 catch with the inner surfaces of the groove where they are now located resisting the movement of the insert 64, mesh 49 and clip 61 relative to the groove 60 in this direction.

The insert 64 is then held in place by the compression of the surface of the groove 60, the clip 61 ensuring that the mesh is held securely in the groove, and the mesh across the seat remains taut even when the material may be softened by hot weather and even after repeated application of user's bodyweight during use of the seat.

The top strut 54 may include a ledge 63 to support the mesh 49 and provide a greater surface area for users of the chair 10, and the other struts are similarly provided with such a ledge.

The inner wall 52 of the side struts 56 extends downwards to form partition walls 58, so that together with the front wall 50, rear wall 51 and inner wall 52 of the bottom strut 55, a receiving cavity 70 is formed on the bottom strut 55. A moulded cap 65 is shaped and dimensioned to fit this receiving cavity 70.

The mesh is cut to a specific shape to correspond to shape of the back 14, with a PVC edge banding stitched to the mesh. The back 14 includes a groove running along the corners of the front walls 50 (not here visible) of the side struts 56, and the mesh 49 is then stretched over the frame 48, and the edge banding of the mesh 49 is then has clips 61 fixed to the insert 64 and mesh 49 and pressed into the groove 60 in the side struts 56. The remaining periphery of the mesh is folded over the front wall 50 (not here visible) of the bottom strut 55 into the receiving cavity 70, and the cap 65 is then inserted into the receiving cavity 70, and the closeness of the fit between the receiving cavity 70 and the cap 65 retains the mesh 49 in position at the bottom of the back 14. The inner wall 52 of the bottom strut 55 includes threaded posts, and the cap 65 has apertures that correspond to these threaded posts, so that the cap 65 can be retained in the receiving cavity 70 using screws 80. These threaded posts, as well as the threaded posts 67 are aligned with the line of draw of the moulded frame 48. The screws that engage with these threaded posts can be self tapping.

The mesh is thus easily fitted to the back 14 in a convenient and secure manner. If it is necessary to change the mesh, this can be achieved by removing the cap 65 and prising the insert 64 from the top strut 54, and then repeating the process above with a new piece of mesh.

The seat 12 is configured in the same manner.

Many variations are possible without departing from the scope of the present invention as defined in the appended claims.

The invention claimed is:

1. A seat or back for a chair comprising:

a frame having a first edge strut and a second edge strut, the first and second edge struts being on opposite edges of the seat or back;

the first edge strut having a groove along all or most of its length;

an elongate insert;

a mesh, the mesh being attached to the insert along an edge of the mesh;

the insert having a section shaped to correspond to the section of the groove, such that the insert can be urged into the groove, the compression of the groove holding the insert in place; and C-shaped clips which fit over an edge of the elongate insert and mesh, the clips having barbs on inner surfaces of the clips that allow the clip to be fitted over the elongate insert and mesh, but which resist the removal of the clips from the elongate insert and mesh.

2. A seat or back for a chair according to claim 1, further comprising a cap securable to the second edge strut, such that when the insert is located in the groove of the first strut, the mesh can be positioned over the seat or back, and the edge of the mesh opposite the insert can be secured between the cap and the second edge strut.

3. A seat or back for a chair, comprising:

a frame having a first edge strut and a second edge strut, the first and second edge struts being on opposite edges of the seat or back;

the first edge strut having a groove along all or most of its length;

an elongate insert;

a mesh, the mesh being attached to the insert along an edge of the mesh;

the insert having a section shaped to correspond to the section of the groove, such that the insert can be urged into the groove, the compression of the groove holding the insert in place; and C-shaped clips which fit over an edge of the elongate insert and mesh, the clips having barbs on outer surfaces of the clips that allow the clip, the elongate insert and mesh to be inserted into the groove, but which resist the removal of the elongate insert and mesh from the groove.

4. A seat or back for a chair according to claim 3, further comprising a cap securable to the second edge strut, such that when the insert is located in the groove of the first strut, the mesh can be positioned over the seat or back, and the edge of the mesh opposite the insert can be secured between the cap and the second edge strut.

* * * * *